US006752666B1

(12) United States Patent
Wu

(10) Patent No.: US 6,752,666 B1
(45) Date of Patent: Jun. 22, 2004

(54) LOW INSERTION FORCE ELECTRICAL CONNECTOR ASSEMBLY

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/355,548

(22) Filed: Jan. 31, 2003

(51) Int. Cl.[7] ..... H01R 13/04
(52) U.S. Cl. ..... 439/692
(58) Field of Search ..... 439/692, 733.1, 439/610, 741, 682, 816, 848, 701, 856, 857

(56) References Cited

U.S. PATENT DOCUMENTS

| | | | | |
|---|---|---|---|---|
| 3,833,879 A | | 9/1974 | Aidn et al. | |
| 4,175,821 A | | 11/1979 | Hunter | |
| 4,607,907 A | | 8/1986 | Bogursky | |
| 4,735,588 A | | 4/1988 | Bird et al. | |
| 4,740,180 A | | 4/1988 | Harwath et al. | |
| 4,941,853 A | | 7/1990 | Harwath | |
| 5,290,181 A | | 3/1994 | Bixler et al. | |
| 5,558,542 A | | 9/1996 | O'Sullivan et al. | |
| 5,667,411 A | | 9/1997 | O'Sullivan et al. | |
| 5,692,928 A | | 12/1997 | Nelson et al. | |
| 5,722,861 A | * | 3/1998 | Wetter | 439/701 |
| 5,807,142 A | | 9/1998 | O'Sullivan | |
| 6,113,438 A | * | 9/2000 | O'Sullivan | 439/740 |
| 6,290,548 B1 | | 9/2001 | Yeh | |
| 6,312,294 B1 | * | 11/2001 | Lai | 439/692 |

FOREIGN PATENT DOCUMENTS

| | | |
|---|---|---|
| TW | 454995 | 9/2001 |
| TW | 484754 | 4/2002 |

* cited by examiner

*Primary Examiner*—Jean F. Duverne
(74) *Attorney, Agent, or Firm*—Wei Te Chung

(57) ABSTRACT

An electrical connector assembly (1) includes a plug connector (2) and a receptacle connector (3). The plug connector includes an insulative housing (20) defining a number of passageways (205) and a number of electrical contacts (22) received in the passageways and each having a pair of slanted fingers (222). The receptacle connector has an insulative housing (30) defining a number of grooves (306) and a number of electrical contacts (32) formed with slanted resilient arms (322) extending in the grooves. The fingers extend into the grooves to electrically contact with the resilient arms with a low insertion force.

8 Claims, 16 Drawing Sheets

LOW INSERTION FORCE ELECTRICAL CONNECTOR ASSEMBLY

BACKGROUND OF THE INVENTION

1. Field of the Invention

The present invention relates to an electrical connector assembly, and particularly to an electrical connector assembly comprising a plug connector and a receptacle connector matable with the plug connector.

2. Description of the Prior Art

Various single and dual spring arm female electrical terminals have been provided in the past for making electrical contact with male terminals such as pins, blades, edge card contact pads and the like. Generally, in these arrangements, the male terminal must be inserted into the female terminal with sufficient force to overcome the resistance to insertion presented by the female terminal. The insertion force of the contact structure includes a lifting component which represents the force required to lift or spread the female contact portions apart to permit passage of the male terminal into the female terminal and also a horizontal frictional component provided as the female contact portions wipe against the male terminal during the insertion.

In multicircuit arrangements including a large number of female terminals mounted in a connector adapted to mate with a male connector including a correspondingly large number of male terminals, the individual insertion forces associated with each pair of contacts combine so that the overall insertion force required to mate the male and the female connectors can be extremely large.

Earlier efforts to provide an electrical contact structure characterized by reduced insertion force have generally included modifying the female terminal contacts. In U.S. Pat. No. 4,175,821, for example, a female terminal is disclosed including a dual opposed spring arm contact member wherein the contact portions of the opposed arms are axially offset from one another in the longitudinal direction. As the pin contact is inserted between the female spring arms, the pin engages the first spring arm on the female terminal and lifts it out of the way, before contacting the second spring arm and moving that contact out of the way. A lower peak insertion force is provided by the arrangement because the lifting force needed to deflect the female terminal to a final mated position is broken down into two smaller lifting steps, lifting one spring arm at a time during the insertion stroke instead of two at a time.

The design described in the patent has several shortcomings. For example, the female terminal is adapted to receive a conventional square pin male terminal which includes a relatively short, chamfered tip portion. The tip portion of the male terminal typically is a rough machine surface which wipes against the precious metal plated contact portion on the female terminal. Repeated mating results in abraded contacts which tends to make the contact arrangement electrically unreliable in prolonged use. Increasing the precious metal plating in the contact area results in increased cost which is also undesirable.

Another modified low insertion force female terminal is disclosed in U.S. Pat. No. 4,607,907. The female contact in this patent is a stamped and formed terminal including a rearward box member from which extend cantilevered spring arms including contact portions at their free ends. The contact portions are axially longitudinally offset as were the contact portions in the aforementioned patent, but in addition, they are configured so that overshoot the midline of the insertion region which permits lower spring rates to be used. The female contact further includes horizontal spacing between the cantilevered spring arms so that the contact portions are horizontally spaced one from the other. This permits the contact portions to be plated with precious metals in a lower cost process. This female contact provides a lower peak insertion force for the same reasons, i.e. the male lifts one cantilevered spring arm at a time during insertion. The overshot design of the contact portions permits lower spring rates in the spring members to be used, so that the stiffness of each spring member is reduced and the force required to lift each spring arm contact during pin insertion is reduced.

This design also possesses several shortcomings. As with the first mentioned female, the rough cut abrasive edge of the chamfered lead-in on the male pin scrapes against the precious metal coated contact portions of the spring arms during pins insertion. Long term electrical reliability in repeated mating operations is generally not obtained. The female terminal is stamped and then formed in a manner which produces a significantly large amount of wasted sheet metal stock. Furthermore, because these female terminals are formed after stamping to provide the box portion and opposed spring arm structure, they cannot be provided on a carrier strip spaced apart by center line spacings adapted for ready insertion in a connector housing in a single stamping operation. Instead, after they are formed, they must be repositioned to a spacing appropriate for insertion into a housing. This requires additional manufacturing and assembly steps in use.

Another approach to providing a low insertion force contact is disclosed in U.S. Pat. No. 4,735,588. The mating electrical contact structure described therein includes an electrically conductive elongated tubular female receptacle contact having at least one resilient elongated beam. Either the female tubular receptacle or the male terminal includes a predefined longitudinally extending rotational skew or twist profile. As the male terminal is inserted into the female receptacle, the resilient beam on the male terminal is progressively deflected along the predefined rotational skew. In accordance with the design, the rotational deflection provides a torque which generates the mated contact force between the male and female contacts. The degree of the rotational skew in this contact arrangement determines the amount of progressive deflection during insertion.

This design also has some shortcomings. The male terminal member in at least one embodiment must be assembled and the additional assembly steps add to the cost of the contact structure. Another disadvantage in manufacturing is encountered because the interior of the tubular female member is extremely difficult to plate with precious metals satisfactorily after it is formed. The opposed inner surfaces will create field effect interference in plating operations, resulting in poor or lower quality plating. Moreover, the contact design structure is very sensitive to misalignment of the mating female and male terminals. If the male terminal member is positioned to be slightly offset from the central axis of the tubular female, the low insertion force characteristics can be changed into very high insertion forces because a misalignment will tend to deflect or try to deflect nonresilient members in the system.

U.S. Pat. No. 4,740,180 discloses a low insertion force mating electrical contact structure which includes a male terminal having a twisted lead-in portion with at least one surface adapted to engage at least one contact of a female terminal. During insertion the twisted lead-in portion of the male terminal is effective to gradually cam outwardly contact portions of a pair of spring arms of the female terminal from an initial position to a final mated position to provide a lower overall insertion force and at the same time provide a high contact normal force between the female and the male terminals. The mating electrical contact structure and camming profile disclosed in this patent have proven effective to provide a highly reliable, lower insertion force contact interface. However, the design is not easily adaptable for miniaturization beyond a certain point, i.e., for reducing individual terminal size in order to produce denser arrays of terminal size in order to produce denser arrays of terminals in increasingly smaller packages. Furthermore, the solid lead-in portion of the male terminal has limited mating depth and does not generally permit applications in which sequential or staggered mating may be required. They may provide potential problems in some specific connector applications.

Therefore, an electrical connector assembly with improved low insertion force structure is desired to overcome the disadvantages of the prior art.

SUMMARY OF THE INVENTION

A first object of the present invention is to provide an electrical connector assembly comprising a plug connector and a receptacle connector matable with the plug connector with a low insertion force.

A second object of the present invention is to provide an electrical connector assembly having a reliable electrical connection between a plug connector thereof and a receptacle connector thereof with a reduced cost.

A third object of the present invention is to provide an electrical connector assembly manufactured with a simplified process and without dimension limitation.

An electrical connector assembly in accordance with the present invention comprises a plug connector and a receptacle connector matable with the plug connector. The plug connector comprises an insulative housing and a plurality of electrical contacts. The insulative housing comprises a base portion defining a plurality of passageways and a mating portion extending from the base portion and defining a receiving cavity in communication with the passageways. Each passageway comprises a main portion and a pair of divergent portion extending oppositely perpendicularly from two opposite ends of the main portion. Each electrical contact comprises a contact portion and a pair of fingers slantedly extending from the contact portion. In assembly, the contact portions and the fingers of the electrical contacts respectively extend through the main portions and the divergent portions of the passageways into the receiving cavity.

The receptacle connector comprises an insulative housing and a plurality of electrical contacts. The insulative housing comprises a base portion defining a plurality of passageways and a mating portion defining a plurality of grooves extending therethrough and communicating with corresponding passageways. Each passageway comprises a main portion extending through the base portion and a pair of divergent portion extending outwardly from upper and lower sections of a part of the main portion. Each electrical contact comprises a transitional portion, a retention portion, a tail portion and a resilient arm. A pair of electrical contacts are inserted from each groove through one corresponding passageway with the resilient arms extending in the groove while the tail portions and the transitional portions extending in the main portion of the passageway and the retention portions retained in the divergent portions of the passageway. The tail portion extends partially beyond the insulative housing. The resilient arms electrically engage with the fingers extending into the groove when the mating portion of the receptacle connector is plugged into the mating portion of the plug connector with a low insertion force.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
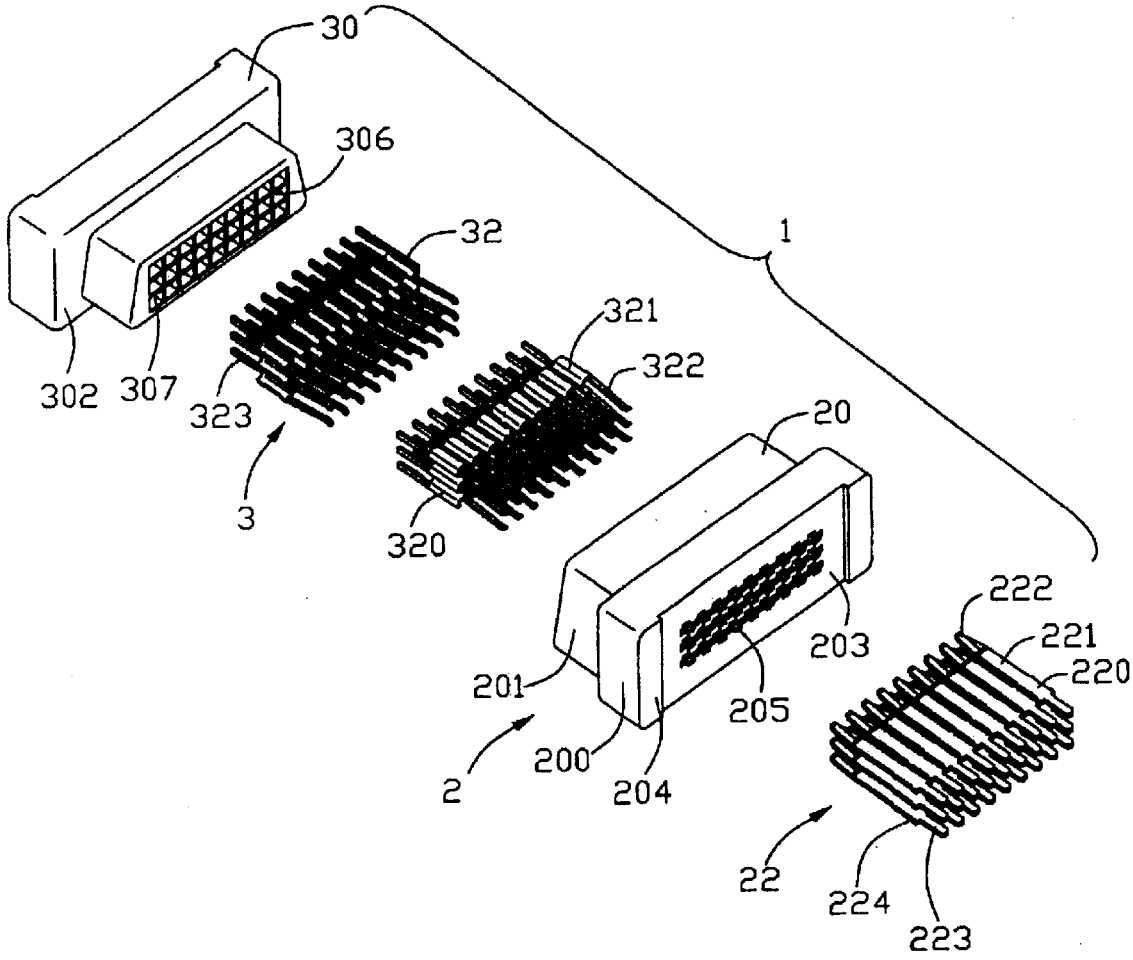
FIG. 1 is an exploded view of an electrical connector assembly in accordance with the present invention.
Figure 2:
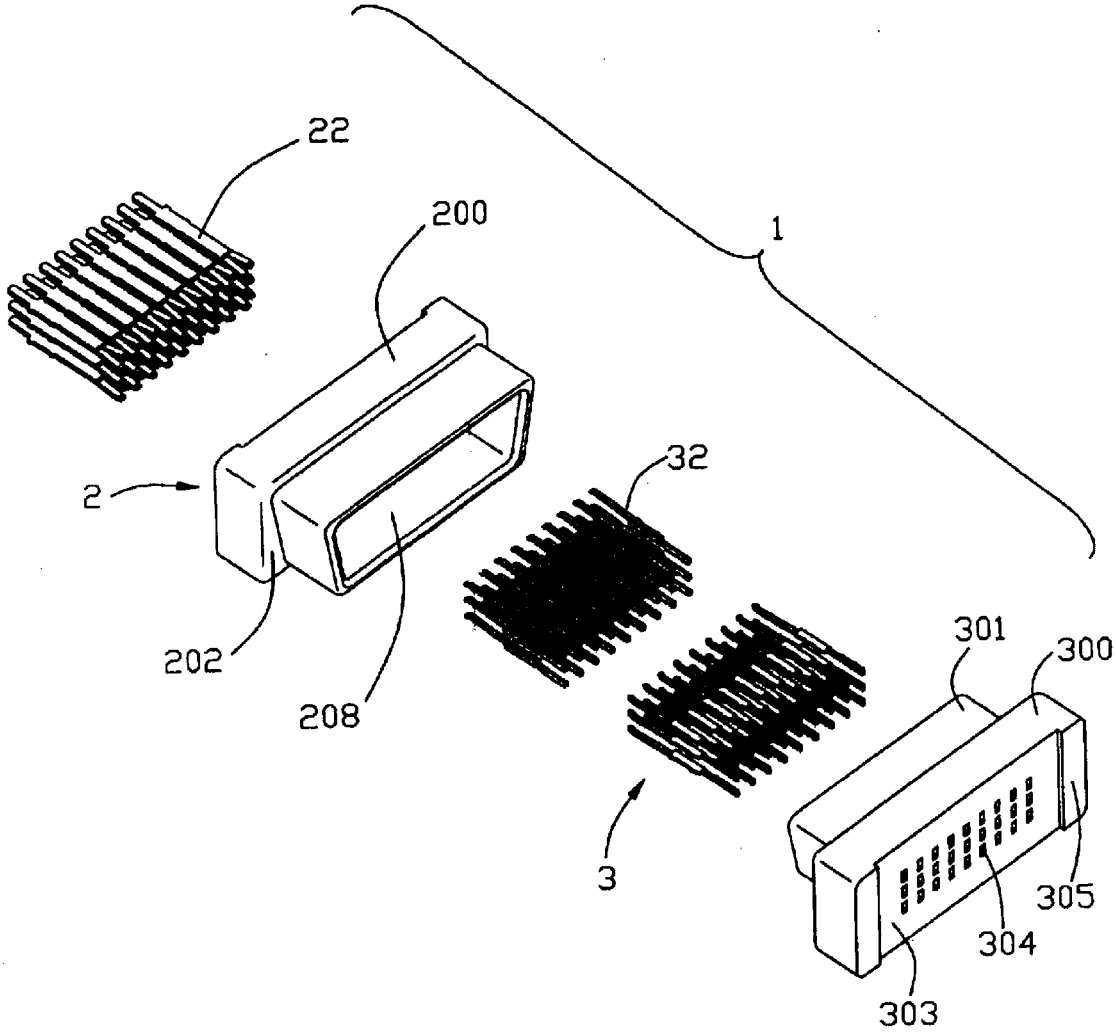
FIG. 2 is a view similar to FIG. 1 but taken from a different perspective.

Referring to FIGS. 1 to 2, an electrical connector assembly 1 in accordance with the present invention comprises a plug connector 2 and a receptacle connector 3 matable with the plug connector 2.

The plug connector 2 comprises an insulative housing 20 and a plurality of electrical contacts 22. The insulative housing 20 comprises a rectangular base portion 200 and a D-shaped mating portion 201. The base portion 200 comprises a mating face 202, an engaging face 203 opposite to the mating face 202 and a pair of supporting sections 204 extending from two opposite ends thereof beyond the engaging face 203. The base portion 200 defines a plurality of passageways 205 extending through the mating face 202 and the engaging face 203.

Figure 6:
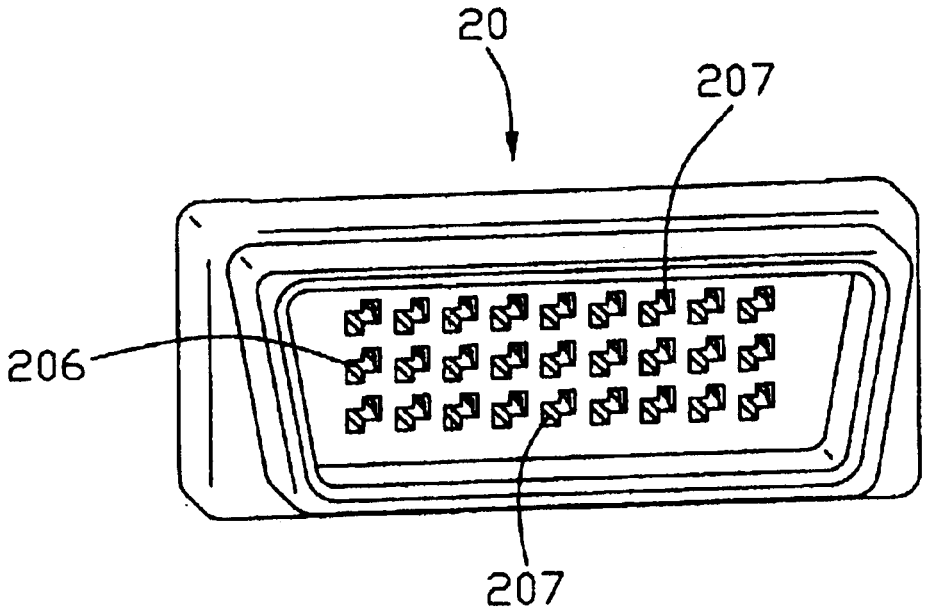
FIG. 6 is a perspective view of an insulative housing of the plug connector of FIG. 3.
Figure 7:
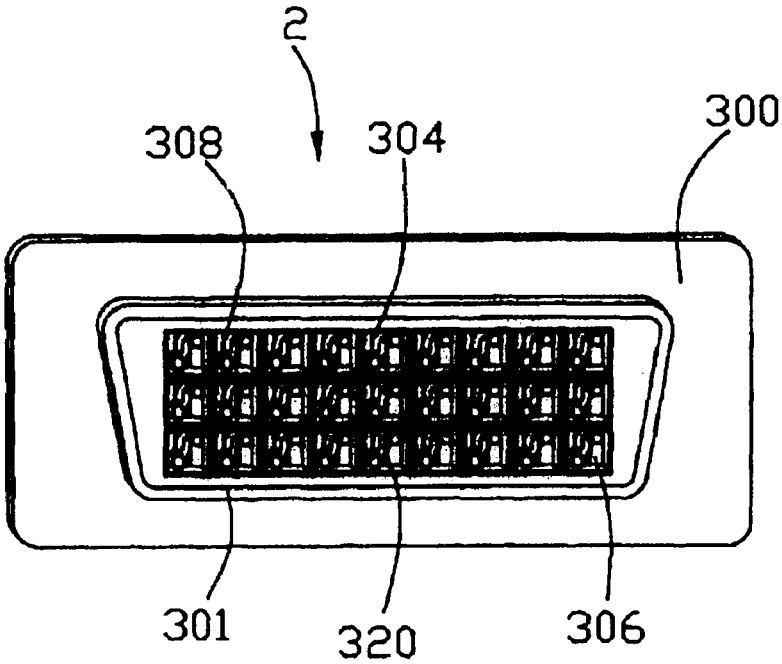
FIG. 7 is a perspective view of a receptacle connector of the electrical connector assembly of FIG. 1.
Figure 8:
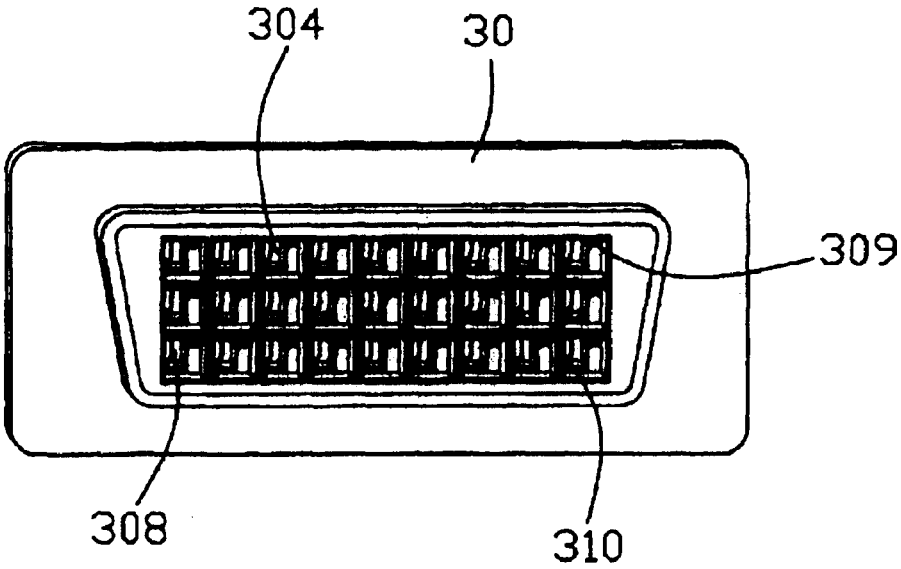
FIG. 8 is a perspective view of an insulative housing of the receptacle connector of FIG. 7.
Figure 9:
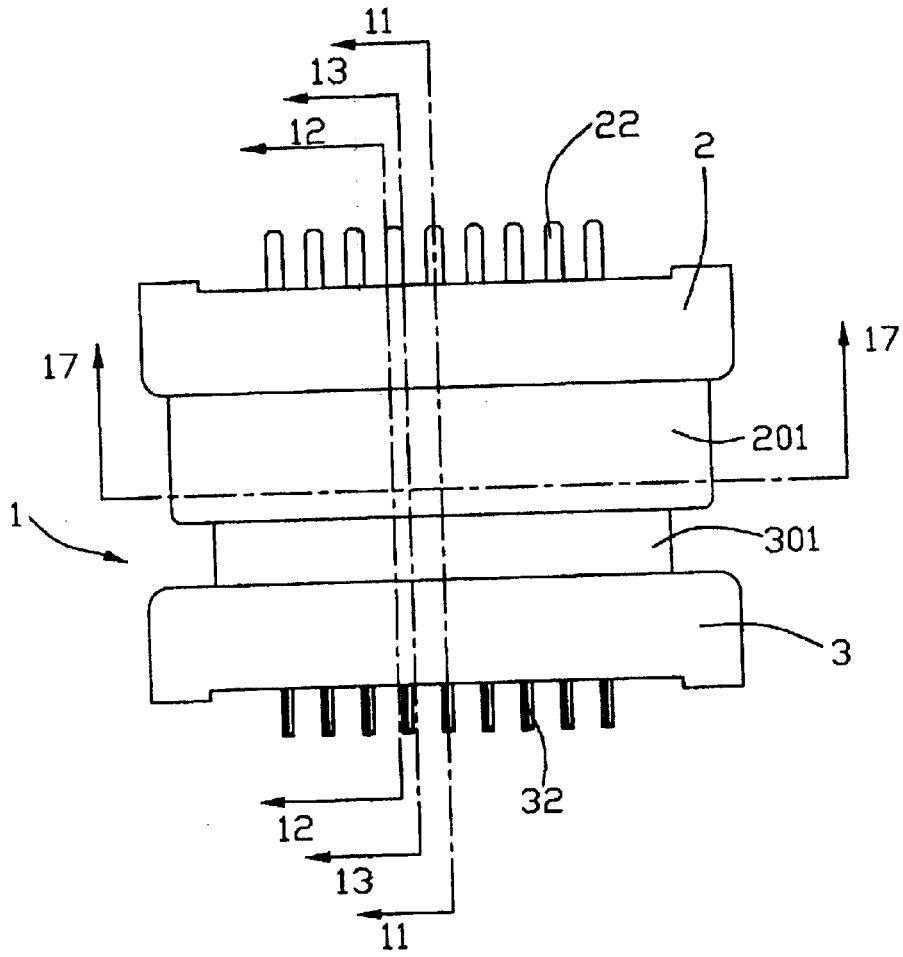
FIG. 9 is a top plan view of the electrical connector assembly of FIG. 1 before the plug connector and the receptacle connector thereof are completely mated with each other.
Figure 10:
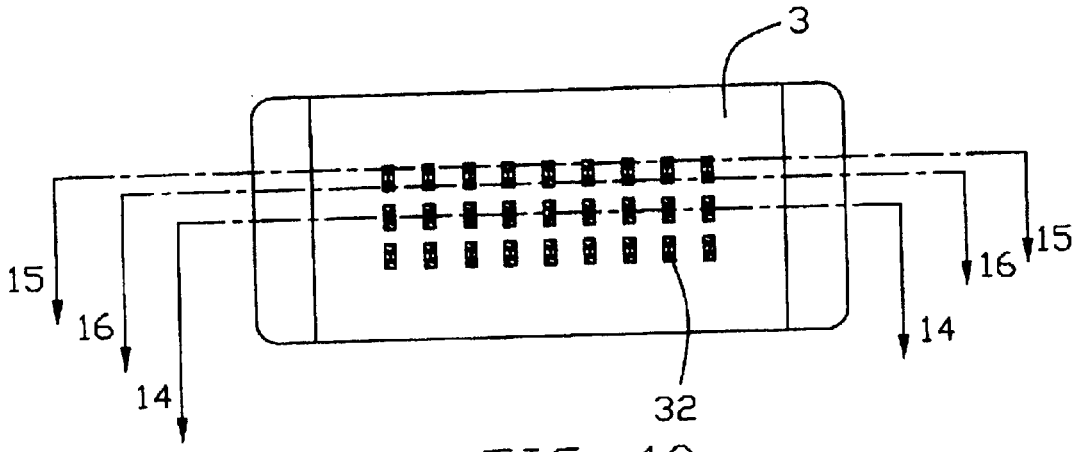
FIG. 10 is a front elevational view of FIG. 9.
Figure 11:
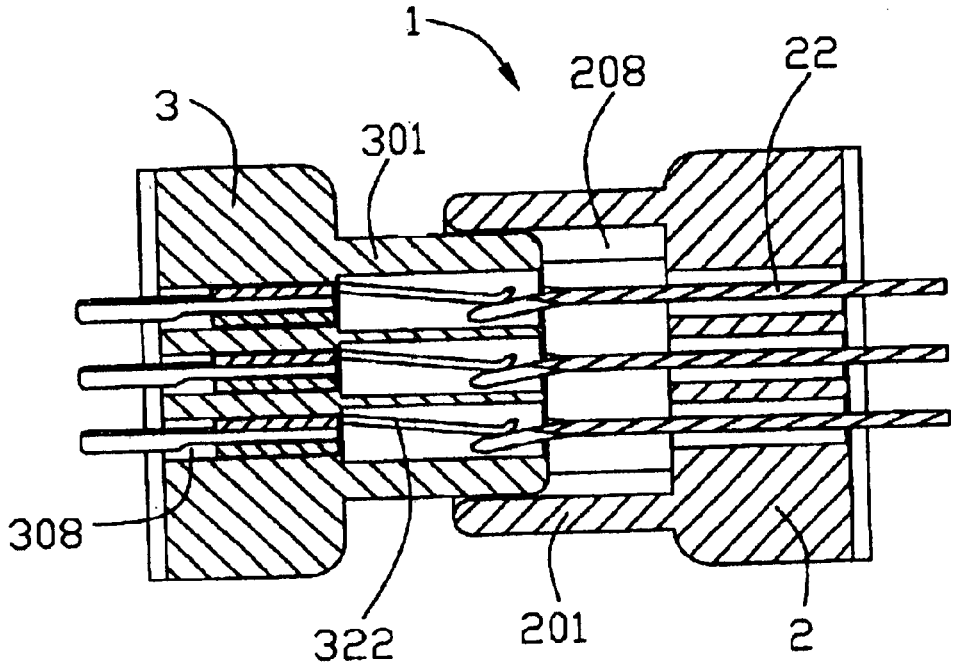
FIG. 11 is a cross-sectional view taken along line 11—11 of FIG. 9.
Figure 12:
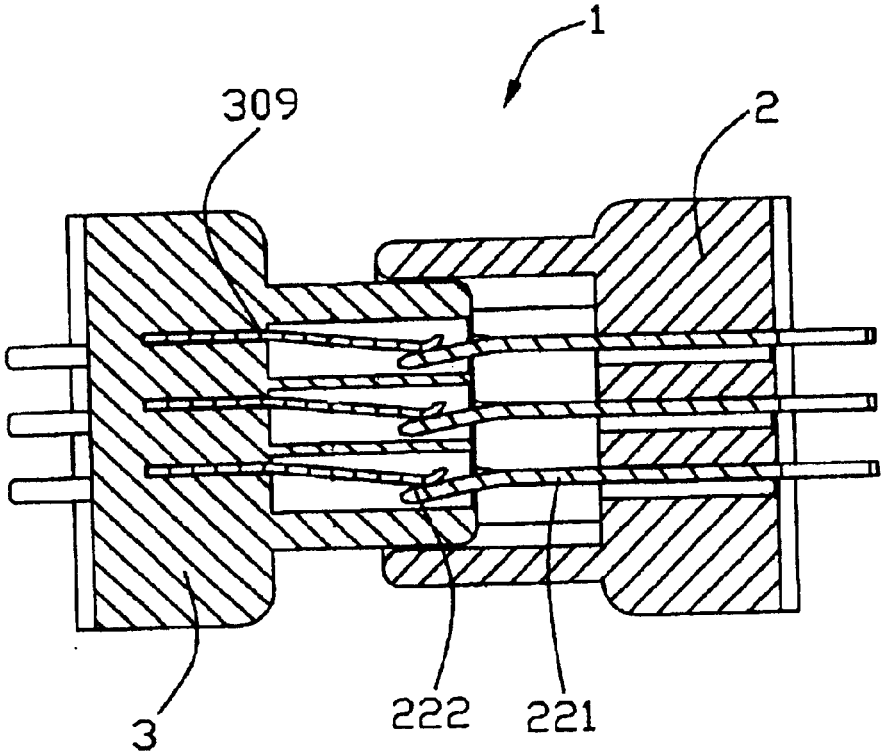
FIG. 12 is a cross-sectional view taken along line 12—12 of FIG. 9.
Figure 13:
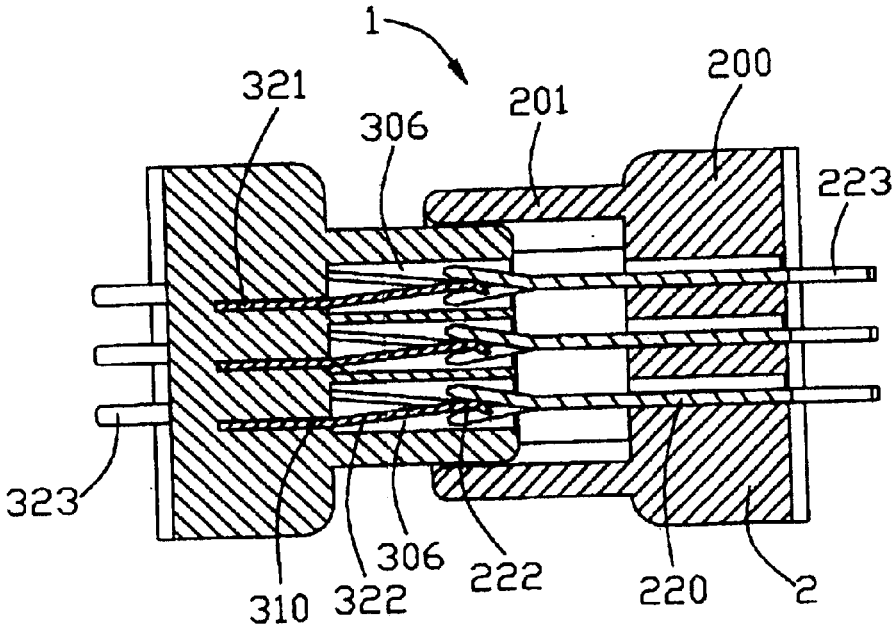
FIG. 13 is a cross-sectional view taken along line 13—13 of FIG. 9.
Figure 14:
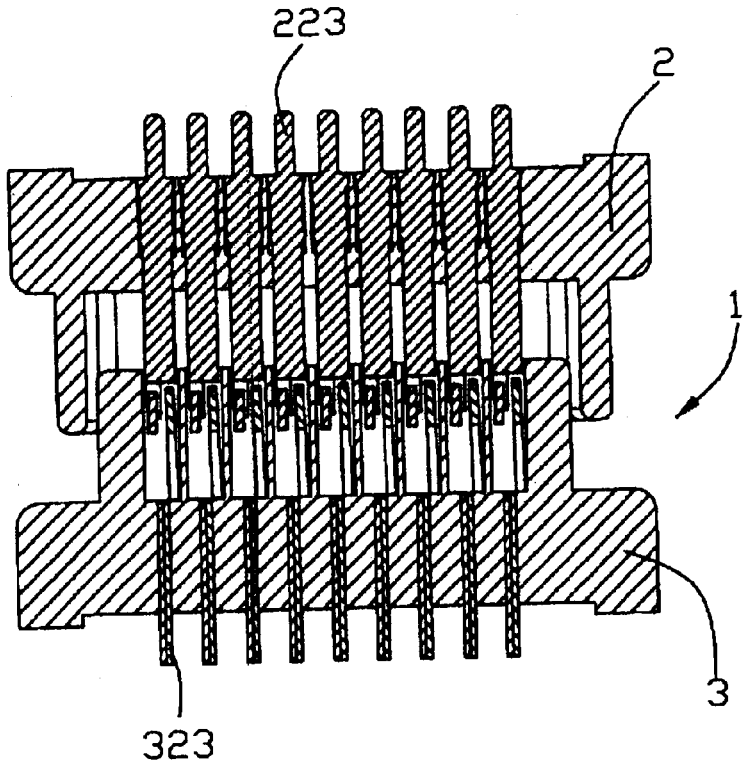
FIG. 14 is a cross-sectional view taken along line 14—14 of FIG. 10.
Figure 15:
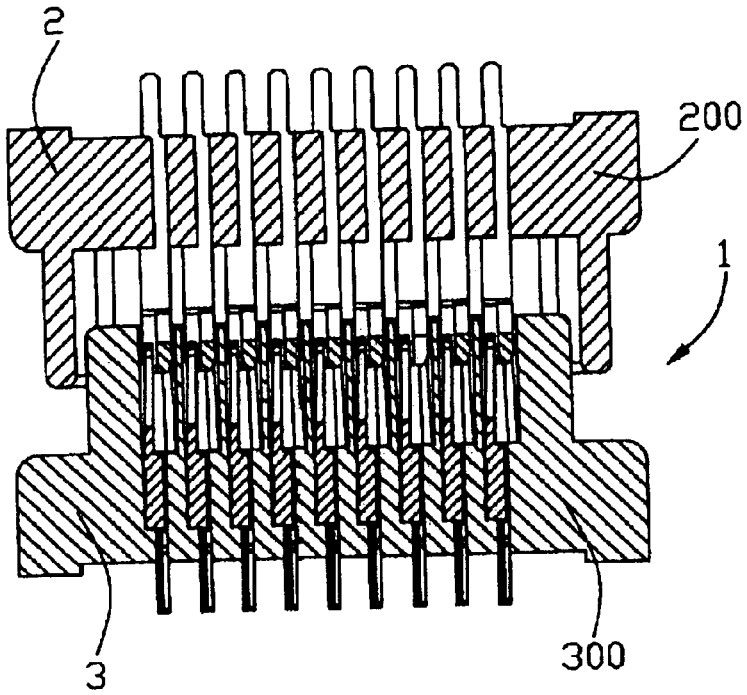
FIG. 15 is a cross-sectional view taken along line 15—15 of FIG. 10.
Figure 16:
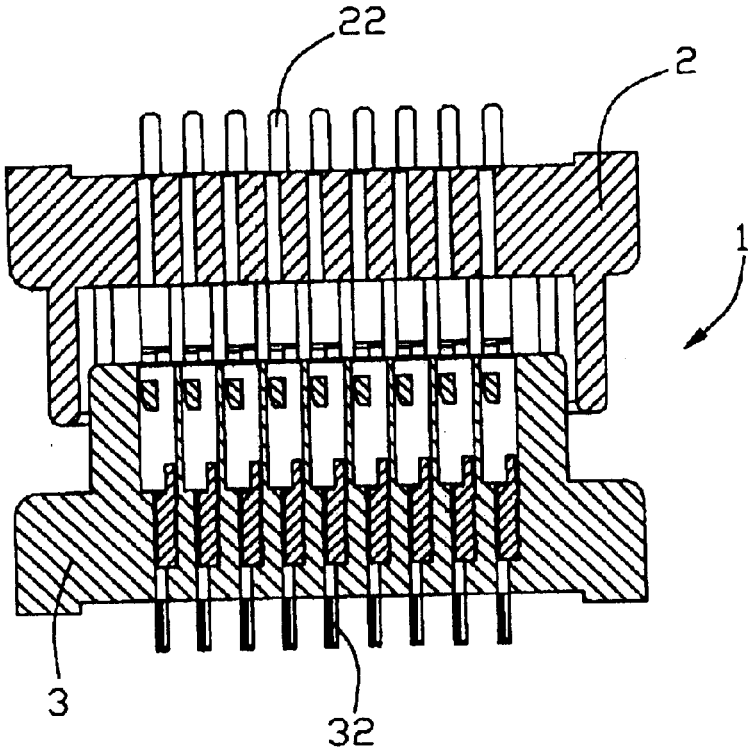
FIG. 16 is a cross-sectional view taken along line 16—16 of FIG. 10.
Figure 17:
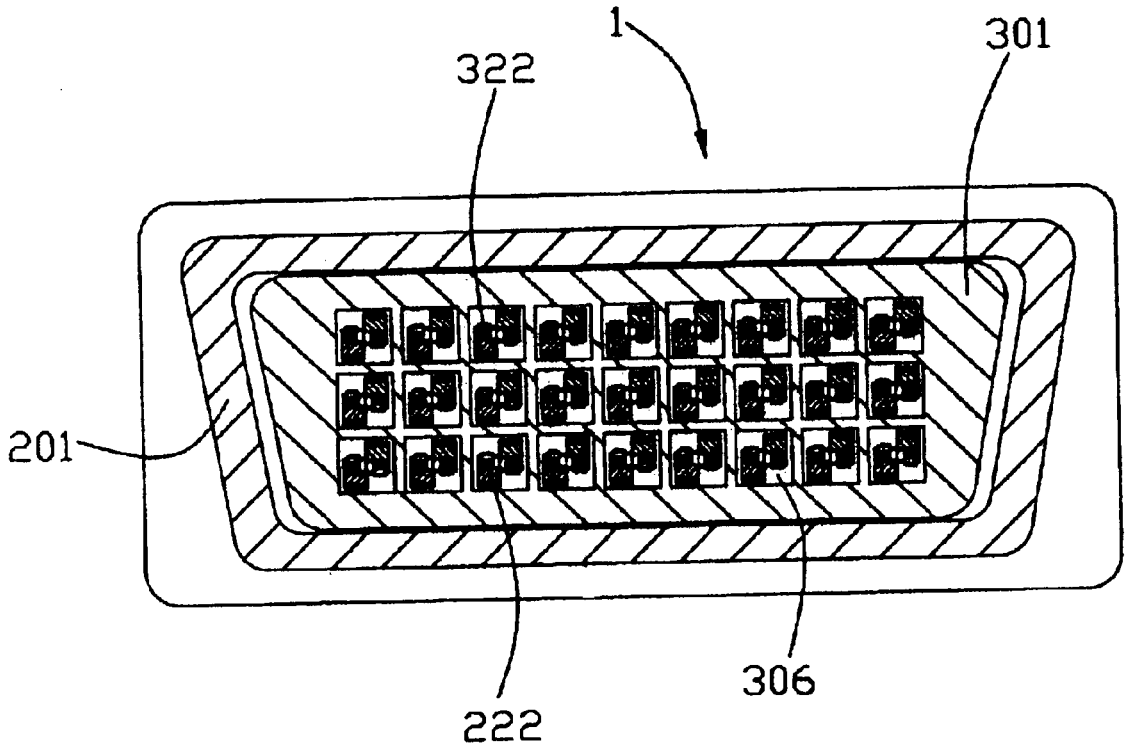
FIG. 17 is a cross-sectional view taken along line 17—17 of FIG. 9.
Figure 18:
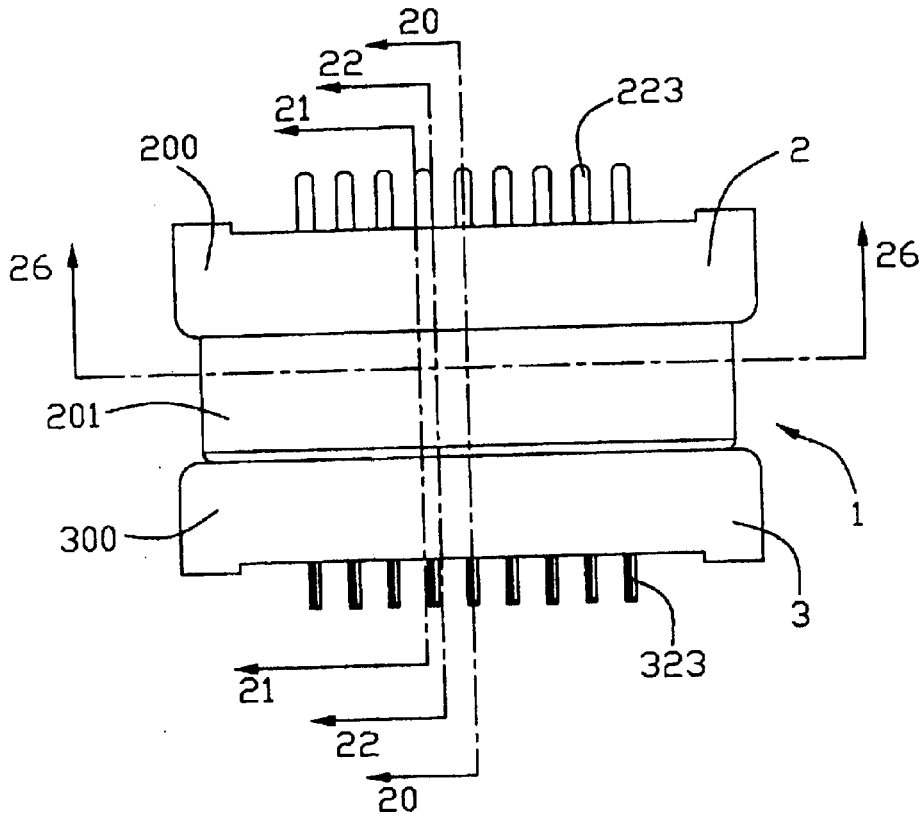
FIG. 18 is a view similar to FIG. 9 but the plug and the receptacle connectors have been completely mated with each other.
Figure 19:
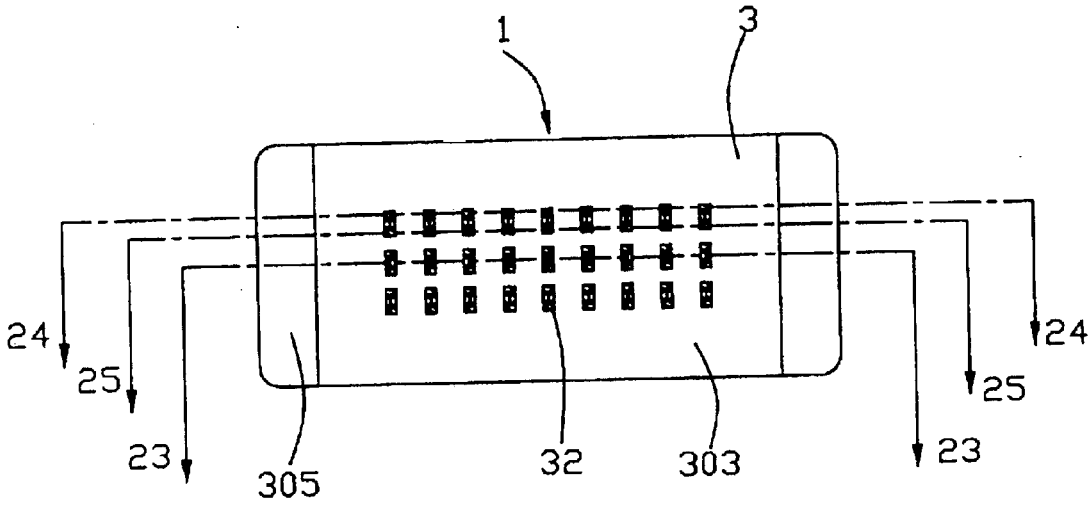
FIG. 19 is a front elevational view of FIG. 18.
Figure 20:
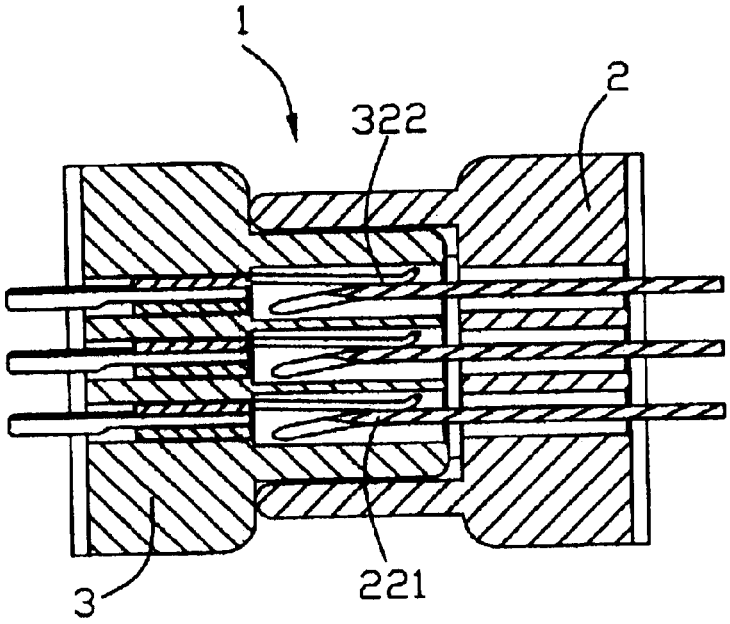
FIG. 20 is a cross-sectional view taken along line 20—20 of FIG. 18.
Figure 21:
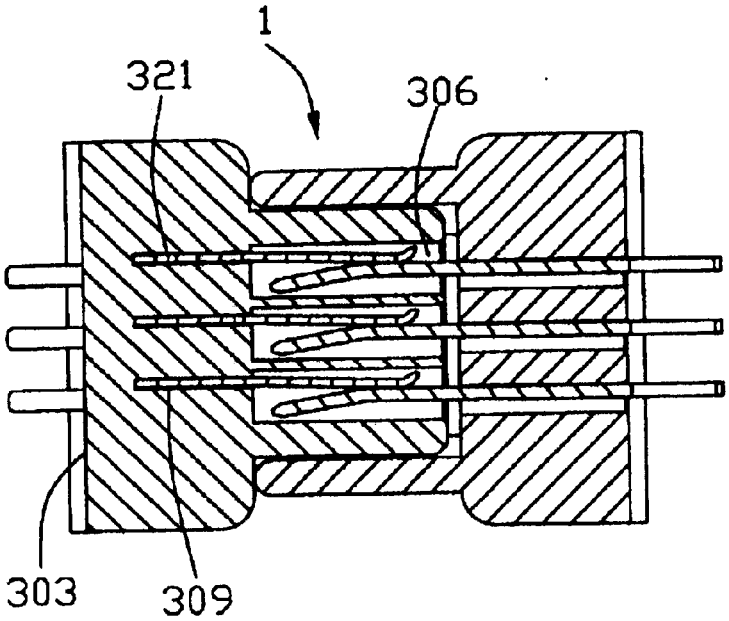
FIG. 21 is a cross-sectional view taken along line 21—21 of FIG. 18.
Figure 22:
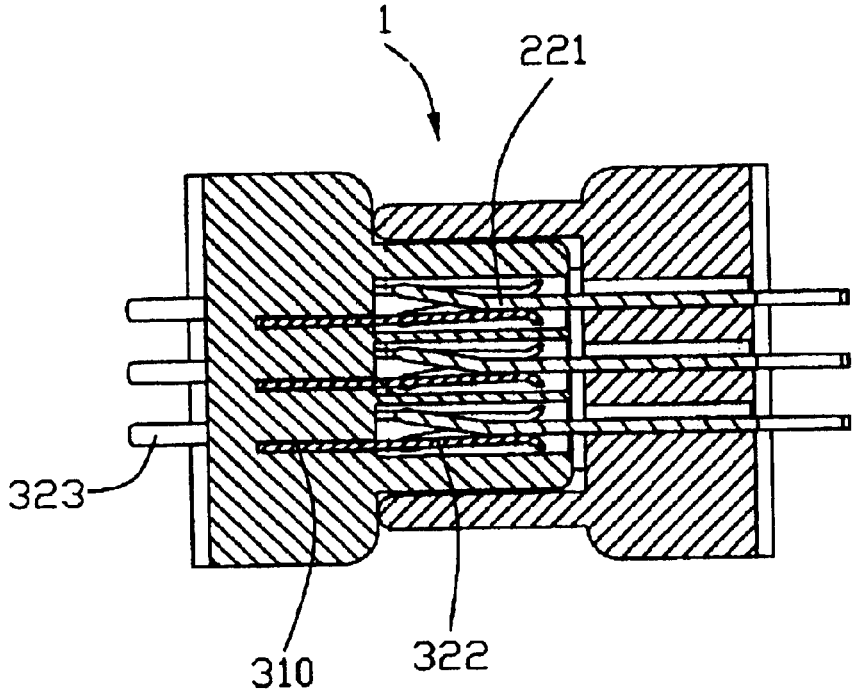
FIG. 22 is a cross-sectional view taken along line 22—22 of FIG. 18.
Figure 23:
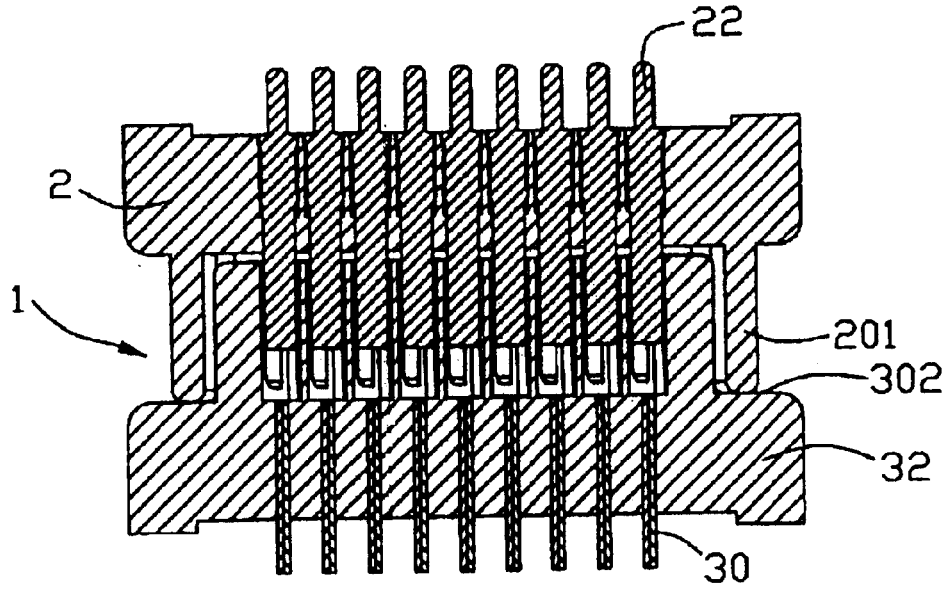
FIG. 23 is a cross-sectional view taken along line 23—23 of FIG. 19.
Figure 24:
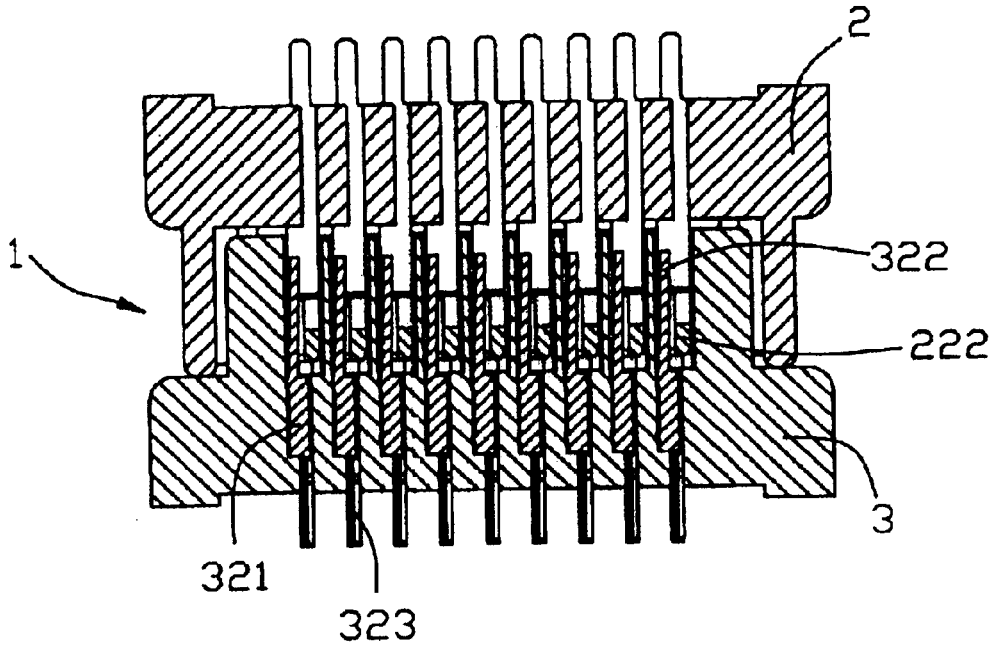
FIG. 24 is a cross-sectional view taken along line 24—24 of FIG. 19.
Figure 25:
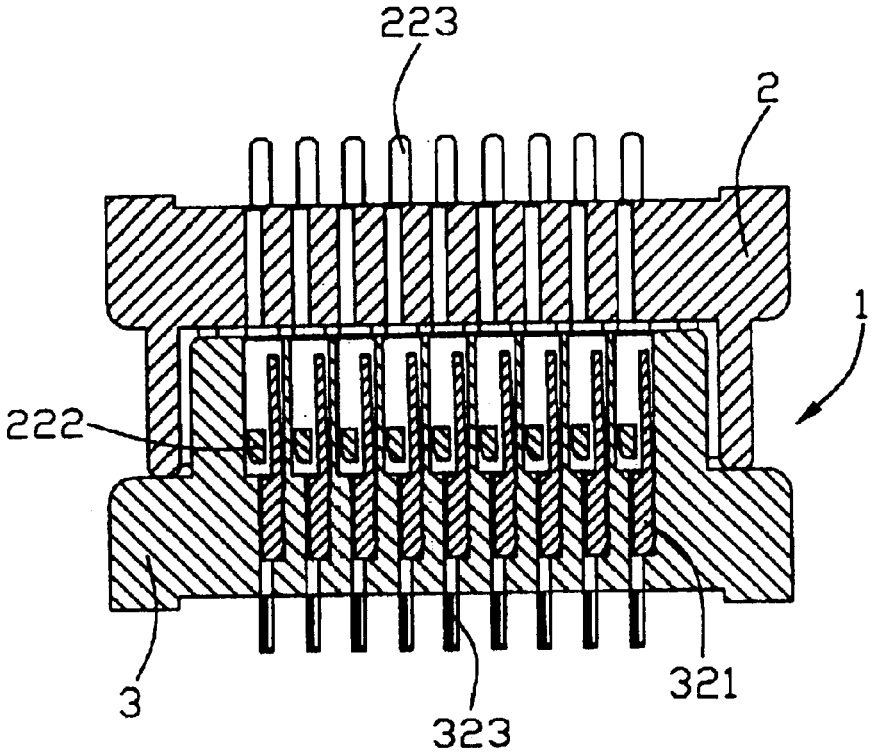
FIG. 25 is a cross-sectional view taken along line 25—25 of FIG. 19.
Figure 26:
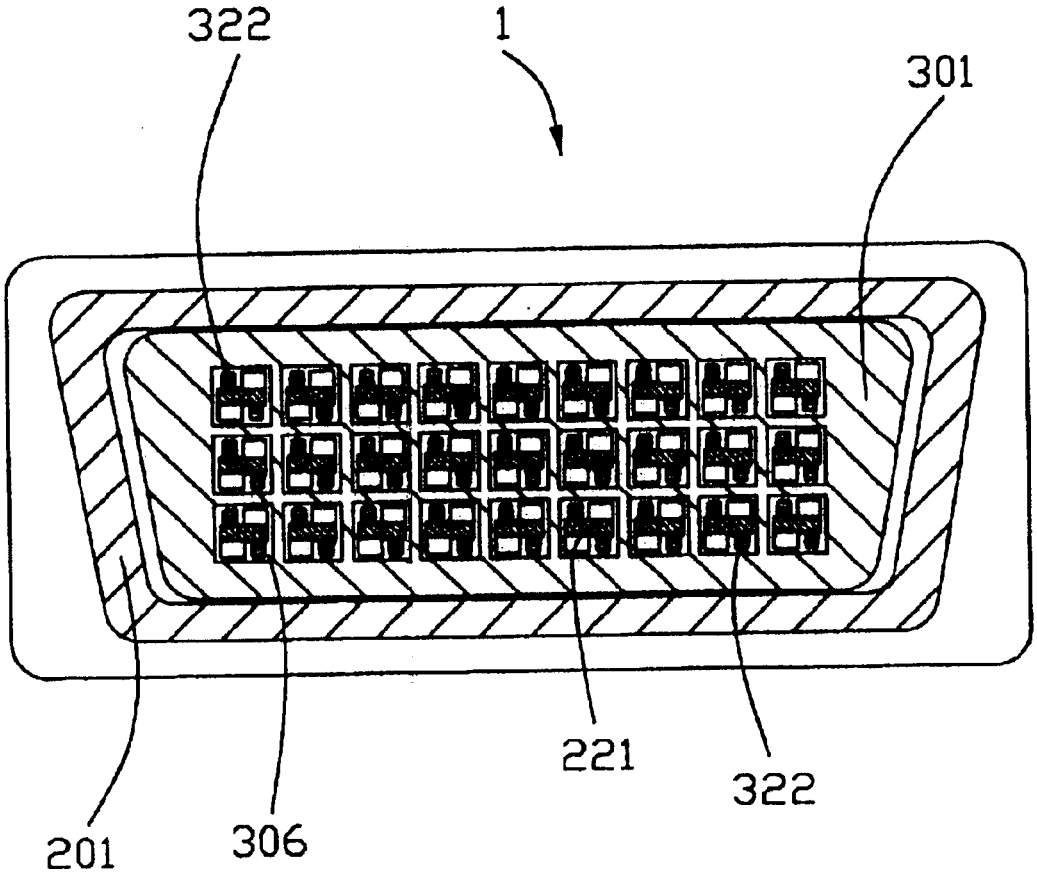
FIG. 26 is a cross-sectional view taken along line 26—26 of FIG. 18.

Referring also to FIG. 6, each of the passageways 205 comprises a horizontal main portion 206 and a pair of divergent portions 207 extending respectively upwardly and downwardly from two opposite ends of the main portion 206. In such a way, the passageways 205 are configured with generally Z-shaped cross-sections. The mating portion 201 extends forwardly from the mating face 202 of the base portion 200 and defines a receiving cavity 208 in communication with the passageways 205.

Each of the electrical contacts 22 comprises a planar retention portion 220, a planar contact portion 221 extending forwardly from the retention portion 220, a pair of separated fingers 222 extending forwardly from the contact portion 221, and a tail portion 223 extending rearwardly from the retention portion 220. The retention portion 220 comprises a plurality of barbs 224 extending outwardly from two opposite sides thereof. One of the fingers 222 of each contact 22 extends slantedly upwardly and the other of the fingers 222 of each contact 22 extends slantedly downwardly.

Figure 3:
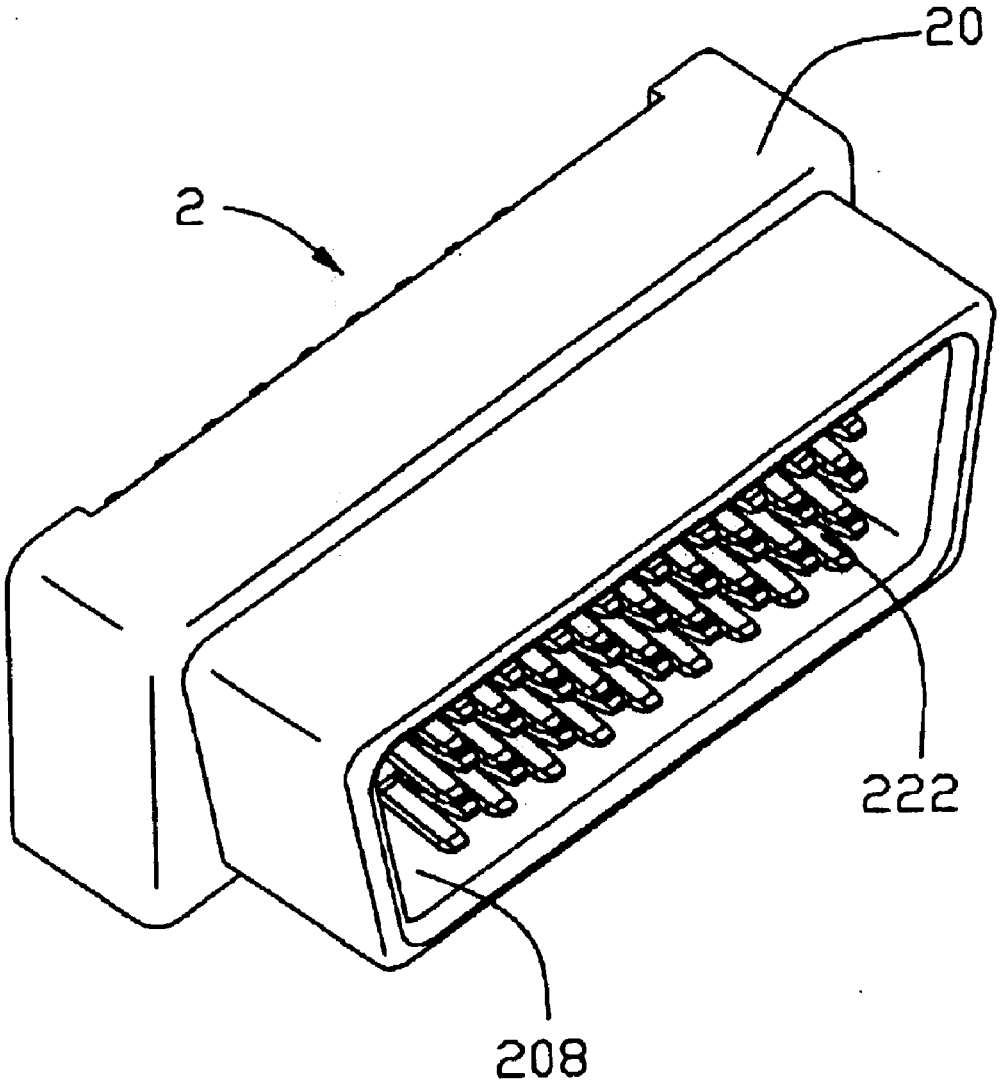
FIG. 3 is a perspective view of a plug connector of the electrical connector assembly of FIG. 1.
Figure 4:
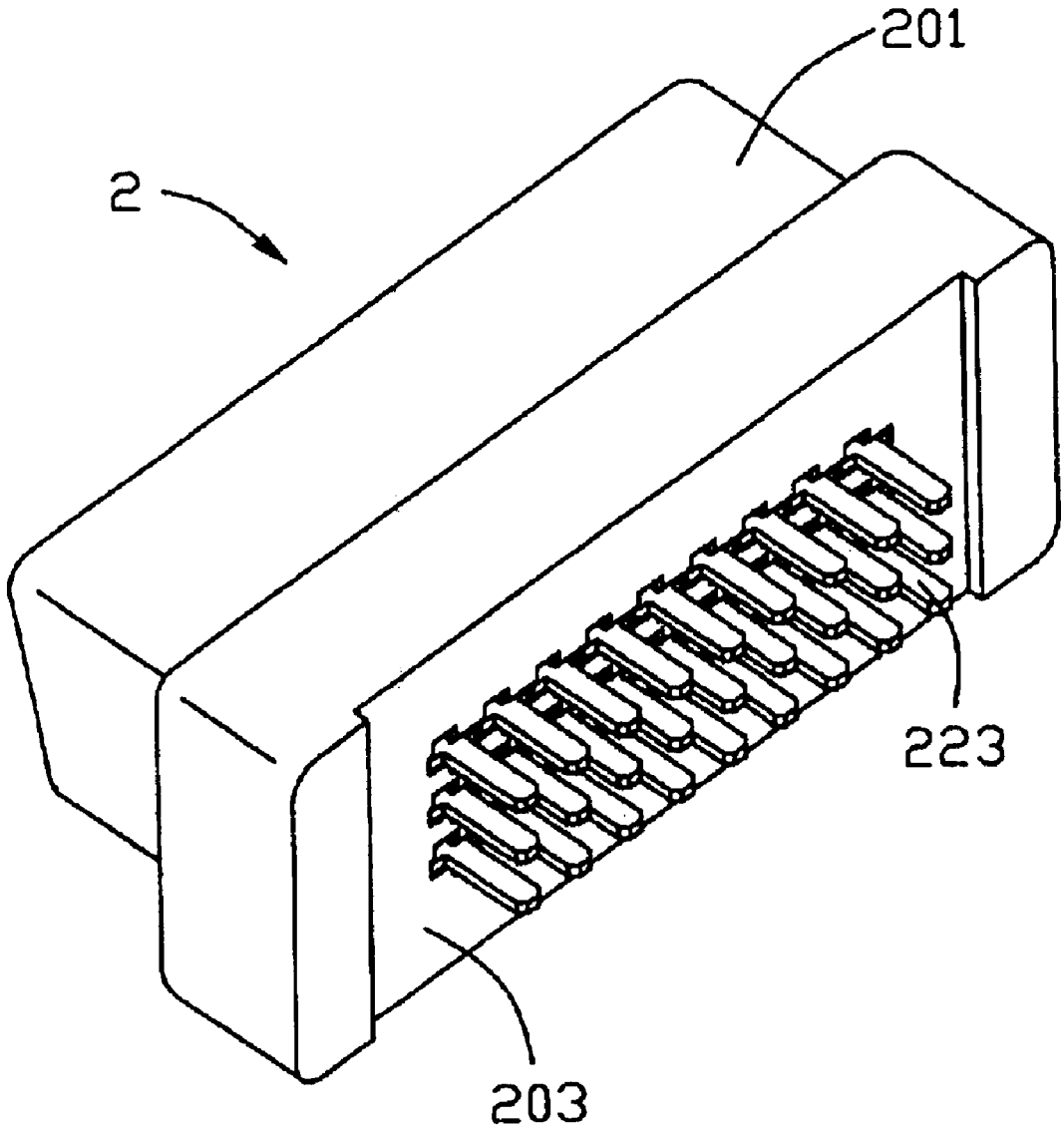
FIG. 4 is a view similar to FIG. 3 but taken from a different perspective.
Figure 5:
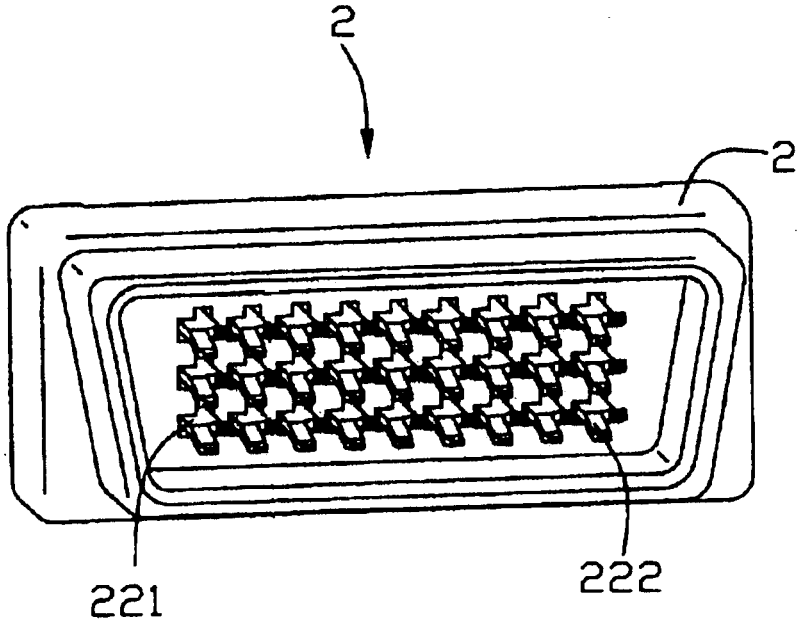
FIG. 5 is a view similar to FIG. 3 but taken from a different perspective.

Referring also to FIGS. 3, 4 and 5, in assembly, the electrical contacts 22 of the plug connector 2 are inserted from the engaging face 203 into the insulative housing 20 of the plug connector 2. The fingers 222 and the contact portions 221 extend into the receiving cavity 208 of the mating portion 201 respectively by way of the divergent portions 207 and the main portions 206 of the passageways 205 before the retention portions 220 are retained in the main portions 206 by means of the engagement of the barbs 224 thereof and base portion 200. The tail portions 223 are located outside of the engaging face 203.

The receptacle connector 3 comprises an insulative housing 30 and a plurality of electrical contacts 32. The insulative housing 30 comprises a rectangular base portion 300 and a D-shaped mating portion 301. The base portion 300 comprises a mating face 302, an engaging face 303 opposite to the mating face 302, a plurality of passageways 304 extending through the mating face 302 and the engaging face 303 and a pair of supporting sections 305 extending from two opposite ends thereof beyond the engaging face 303.

Referring also to FIGS. 8 and 11–13, each of the passageways 304 comprises a vertical main portion 308 extending through the mating face 302 and the engaging face 303 and a pair of divergent portions 309, 310. The main portion 308 is generally rectangular and the divergent portions 309, 310 extend outwardly respectively from upper and lower sections of the main portion 308 and from the mating face 302 rearwardly toward but not to the engaging face 303. That is to say, a rear section of each passageway 304 adjacent to the engaging face 303 has a substantially rectangular cross-section and a front section of each passageway 304 adjacent to the mating face 302 has a substantially Z-shaped cross-section.

The mating portion 301 extends forwardly from the mating face 302 of the base portion 300 and comprises a plurality of grooves 306 extending therethrough. Each groove 306 communicates with a corresponding passageway 304 to construct a receiving channel 307 of the insulative housing 30. The grooves 306 are generally rectangular.

Each of the electrical contacts 32 comprises a generally planar transitional portion 320, a generally planar retention portion 321 extending perpendicularly from one side of the transitional portion 320, a resilient arm 322 extending slantedly forwardly from a front end of the retention portion 321 and a tail portion 323 extending rearwardly from a rear end of the transitional portion 320. The resilient arm 322 and the tail portion 323 are laterally offset from each other. The number of the electrical contacts 32 is twice of the number of the electrical contacts 22.

Referring also to FIGS. 7 and 20–23, each pair of electrical contacts 32 of the receptacle connector 3 are arranged in such a way that the tail portions 323 and the transitional portions 320 thereof respectively abut against each other in a face to face fashion and the transitional portions 320 thereof together with the retention portions thereof 321 are configured in generally Z-shapes on inserting into the insulative housing 30. The pairs of electrical contacts 32 are inserted from the grooves 306 of the mating portion 301 through corresponding passageways 304 of the base portion 300 to be accommodated in the receiving channels 307 of the insulative housing 30 of the receptacle connector 3.

The transitional portions 320 and the tail portions 323 are accommodated in the main portions 308 of the passageways 304 with the tail portions 323 partially extending beyond the engaging face 303. The retention portions 321 extend in the upper and the lower divergent portions 309, 310 of the passageways 304 to engage with the base portion 300 of the insulative housing 30 and retain the electrical contacts 32 to the insulative housing 30 while the resilient arms 322 protrude resiliently into the grooves 306 of the mating portion 301. The resilient arms 322 in each groove 306 are laterally offset from each other and the resilient arm 322 of one of the pair of electrical contacts 32 extends slantedly upwardly in the groove 306 while the resilient arm 322 of the other of the pair of electrical contacts 32 extends slantedly downwardly in the groove 306.

Referring also to FIGS. 9–17, during the course of mating the plug connector 2 with the receptacle connector 3, the mating portion 301 of the receptacle connector 3 is plugged into the receiving cavity 208 of the mating portion 201 of the plug connector 2 with each groove 306 thereof receiving the fingers 222 of one corresponding electrical contact 22 extending thereinto. A force needed to mate the electrical contacts 22 with the electrical contacts 32 in the grooves 306, i.e., the force needed to insert the mating portion 301 into the receiving cavity 208, increases with the further relative movement of the fingers 222 and the resilient arms 322 due to the slanted configurations of the fingers 222 and the resilient arms 322.

Referring also to FIGS. 18–26, when the plug connector 2 and the receptacle connector 3 are completely mated with each other, the contact portions 221 reliably engage with the resilient arms 322 and a front end of the mating portion 201 abuts against the mating face 302. A total insertion force for mating the plug connector 2 and the receptacle connector 3 is significantly reduced compared to conventional electrical connectors (not shown) having electrical contacts thereof without slanted configurations.

The electrical contacts 32 of the receptacle connector 3 are formed with simple structures, thereby simplifying the manufacturing process thereof. In addition, the electrical contacts 22, 32 all can be provided on a carrier strip spaced apart by centerline spacings adapted for ready insertion in a connector housing in single stamping operation, thereby simplifying the assembly process of the electrical connector assembly 1 and reducing the cost of the electrical connector assembly 1.

The electrical contact 22 has two fingers 222 constructed respectively corresponding to the resilient arms 322 of the two electrical contacts 32 in each groove 306 to be inserted into between the two resilient arms 322 without wiping against the precious metal plated on the resilient arms 322, thereby ensuring the long-term reliability of the electrical connection between the plug and the receptacle connectors 2, 3 and further reducing the cost of the electrical connector assembly 1.

The electrical contacts 22 have no twisted structures therein, thereby having no dimension limitation in miniaturization.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first connector comprising a first insulative housing and a plurality of first electrical contacts each comprising a resilient arm; and a second connector comprising a second insulative housing and a plurality of second electrical contacts retained in the second insulative housing, each second electrical contact comprising a contact portion and a finger extending slantedly from the contact portion whereby the resilient arm of the first electrical contact reaches to electrically contact with the contact portion with a low insertion force;

wherein the second insulative housing comprises a base portion defining a plurality of passageways each comprising a main portion for the contact portion extending therethrough and a divergent portion extending from and communicating with the main portion for the finger extending therethrough; wherein the resilient arm is slanted, wherein the second insulative housing comprises the base portion and a mating portion extending from the base portion and defining a receiving cavity and wherein the first insulative housing comprises a base portion and a mating portion extending from the base portion to be received in the receiving cavity; wherein the base portion of the first connector defines a mating face abuttable against the mating portion of the second connector.

2. An electrical connector comprising:

an insulative housing comprising a base portion defining a plurality of passageways extending therethrough, each passageway comprising a main portion and a pair of divergent portions extending from and communicating with the main portion; and a plurality of electrical contacts each comprising a retention portion retained in the main portion of the passageway, a tail portion extending rearwardly from the retention portion beyond the insulative housing, a contact portion extending forwardly from the retention portion and a pair of fingers extending from the contact portion and through the divergent portions of the passageways; wherein the insulative housing comprises a mating portion extending from the base portion and defining a receiving cavity accommodating the fingers of the electrical contacts extending therein; wherein the contact portions of the electrical contacts extend into the receiving cavity of the mating portion.

3. The electrical connector as claimed in claim 2, wherein the mating portion is generally D-shaped and the base portion is generally rectangular.

4. An electrical connector comprising:

an insulative housing comprising a base portion defining a plurality of passageways; and a plurality of electrical contacts received in the passageways and each comprising a transitional portion, a retention portion extending from the transitional portion to retain the electrical contact in the passageway, a tail portion extending from the transitional portion beyond the insulative housing, and a resilient arm extending from the retention portion and laterally offsetting from the tail portion; wherein the insulative housing comprises a mating portion extending from the base portion and defining a plurality of grooves communicating with the passageways and receiving the resilient arms of the electrical contacts extending therein; wherein the base portion defines a mating face and an engaging face opposite to the mating face and each passageway comprises a main portion extending through the mating and the engaging faces and a divergent portion extending from the mating face toward the engaging face and communicating with the main portion; wherein the tail portion and the transitional portion of each electrical contact extend in the main portion of one passageway and the retention portions of the electrical contacts are retained in the divergent portions of the passageways.

5. The electrical connector as claimed in claim 4, wherein each of the passageways has a front section adjacent to the mating face and with a generally Z-shaped cross-section and a rear section adjacent to the engaging face and with a generally rectangular cross-section.

6. The electrical connector as claimed in claim 4, wherein the tail portions and the transitional portions of the pair of electrical contacts abut against each other in a face-to-face fashion.

7. The electrical connector as claimed in claim 4, wherein the transitional portion and the retention portion of the electrical contact are perpendicular to each other.

8. The electrical connector as claimed in claim 4, wherein said contacts are arranged with pairs, and each pair are arranged symmetrically in a diagonal direction, wherein the resilient arms of each pair extend respectively from the corresponding retention portions which are spatially opposite to each other in a parallel relation.

* * * * *